US006119320A

United States Patent [19]

Weiss

[11] Patent Number: 6,119,320

[45] **Date of Patent: *Sep. 19, 2000**

[54] METHOD AND APPARATUS FOR PRODUCING A MULTICOLORED YARN FROM DIFFERENTLY COLORED PART-THREADS OF ENDLESS FILAMENT

[75] Inventor: Hans-Joachim Weiss, Ulisbach, Switzerland

[73] Assignee: Maschinenfabrik Rieter AG, Winterthur, Switzerland

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/783,831

[22] Filed: Jan. 13, 1997

[30] Foreign Application Priority Data

Jan. 12, 1996 [CH] Switzerland ..... 00093/96

[51] Int. Cl.[7] ..... D02J 11/00

[52] U.S. Cl. ..... 28/221; 28/246; 28/262; 28/271

[58] Field of Search ..... 28/220, 221, 240, 28/245, 246, 247, 258, 262, 271; 57/332, 333, 908, 334

[56] References Cited

U.S. PATENT DOCUMENTS

| | | |
|---|---|---|
| Re. 31,376 | 9/1983 | Sheehan et al. . |
| 3,199,281 | 8/1965 | Maerov et al. . |
| 3,255,508 | 6/1966 | Weiss et al. . |
| 3,364,537 | 1/1968 | Bunting et al. . |
| 3,367,100 | 2/1968 | Hughey . |
| 3,426,406 | 2/1969 | McCutchan, Jr. . |
| 3,429,018 | 2/1969 | Rosenstein et al. . |
| 3,479,810 | 11/1969 | Eshuis . |
| 3,827,113 | 8/1974 | Vidal et al. . |
| 3,846,881 | 11/1974 | Erickson . |

(List continued on next page.)

FOREIGN PATENT DOCUMENTS

| | | |
|---|---|---|
| 0039763B1 | 11/1981 | European Pat. Off. . |
| 0110359B1 | 6/1984 | European Pat. Off. . |
| 0123072B1 | 10/1984 | European Pat. Off. . |
| 0123829B1 | 11/1984 | European Pat. Off. . |
| 0133198B1 | 2/1985 | European Pat. Off. . |
| 0310890A1 | 4/1989 | European Pat. Off. . |
| 0485871 | 5/1992 | European Pat. Off. . |
| 0498054A1 | 8/1992 | European Pat. Off. . |
| 0745711A1 | 12/1996 | European Pat. Off. . |
| 0848095A1 | 6/1998 | European Pat. Off. . |
| 1575307 | 7/1969 | France . |
| 2190957 | 2/1974 | France . |
| 2300344 | 12/1990 | Japan . |
| 680140A5 | 6/1992 | Switzerland . |
| 1381937 | 1/1975 | United Kingdom . |
| 9609425 | 3/1996 | WIPO . |

OTHER PUBLICATIONS

International Search Report dated Dec. 1, 1996.

European Patent Office Search Report, Aug. 24, 1998.

Continuous Spin–Draw–Texturizing, IFJ, Oct., 1991.

Use of 'Air Jets' in Yarn Texturizing Processes, IFJ, Feb., 1989.

ITMA 1995: Production of Filament Yarns and Staple Fibers, CFI, Dec. 1995, V.45 Production and Testing of Tanglelaced Yarns, vol. 36/88—May, 1986, Chemiefasem Textilindustrie.

Intermingling/Interlacing: A Broad Survey, Chemisfasern/Textilindustrie vol. 40/92, Jun., 1990.

*Primary Examiner*—Larry D. Worrell, Jr.
*Attorney, Agent, or Firm*—Dority & Manning

[57] ABSTRACT

In the production of multicolored yarn from differently colored filament bundles, the individual bundles may be texturized collectively. Then they are separated again into crimped part-threads 11.3 through 11.5 and are compacted individually in after-compacting means 8 before these part-threads are jointly compacted in a collective compacting means 9 and subsequently are wound up as a yarn 12 in a winding device 10.

35 Claims, 4 Drawing Sheets

U.S. PATENT DOCUMENTS

| | | | |
|---|---|---|---|
| 3,982,310 | 9/1976 | Beck et al. . | |
| 4,025,595 | 5/1977 | Mirhej | 264/103 |
| 4,064,686 | 12/1977 | Whitted et al. . | |
| 4,069,565 | 1/1978 | Negishi et al. . | |
| 4,118,843 | 10/1978 | Schippers et al. . | |
| 4,218,869 | 8/1980 | Newton . | |
| 4,268,940 | 5/1981 | Kuroda et al. . | |
| 4,280,261 | 7/1981 | Nelson . | |
| 4,299,015 | 11/1981 | Marcus et al. . | |
| 4,467,594 | 8/1984 | Eschenbach | 57/908 |
| 4,522,774 | 6/1985 | Donnelly et al. . | |
| 4,570,312 | 2/1986 | Whitener, Jr. . | |
| 4,631,791 | 12/1986 | Symon . | |
| 4,644,622 | 2/1987 | Bauer et al. . | |
| 4,715,097 | 12/1987 | Bogucki-Land . | |
| 4,841,606 | 6/1989 | Coons, III . | |
| 4,894,894 | 1/1990 | Coons, III et al. . | |
| 4,993,130 | 2/1991 | Coons, III et al. . | |
| 4,993,218 | 2/1991 | Schwartz et al. . | |
| 5,054,173 | 10/1991 | Schafer . | |
| 5,148,586 | 9/1992 | Coons, III . | |
| 5,184,381 | 2/1993 | Coons, III et al. . | |
| 5,195,313 | 3/1993 | Coons, III . | |
| 5,220,778 | 6/1993 | Flachmueller et al. . | |
| 5,221,059 | 6/1993 | Coons, III et al. . | |
| 5,251,363 | 10/1993 | Gerhards et al. | 28/221 |
| 5,299,345 | 4/1994 | Flachmueller et al. . | |
| 5,325,572 | 7/1994 | Dickson, III et al. . | |
| 5,327,622 | 7/1994 | Coons et al. | 28/220 |
| 5,379,500 | 1/1995 | Flachmueller et al. . | |
| 5,475,908 | 12/1995 | Scherpf et al. . | |
| 5,613,285 | 3/1997 | Chester et al. | 28/258 |
| 5,645,782 | 7/1997 | Howell et al. . | |
| 5,662,980 | 9/1997 | Howell et al. . | |
| 5,675,878 | 10/1997 | Brown et al. . | |
| 5,715,584 | 2/1998 | Coons, III et al. . | |
| 5,804,115 | 9/1998 | Burton et al. . | |

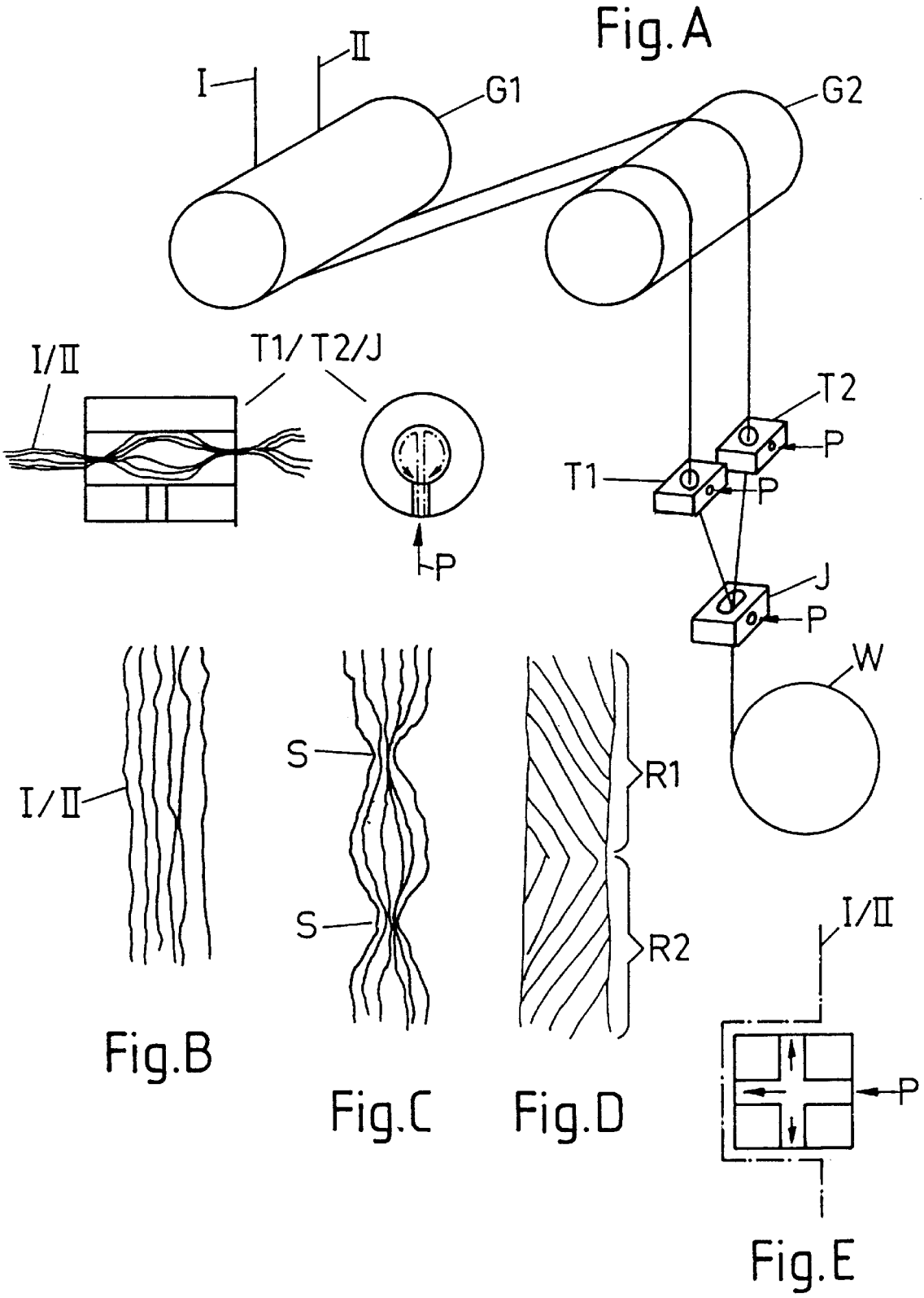
Fig.A
I
II
G1
G2
I/II
T1/ T2/J
T2
P
T1
P
P
J
P
W
I/II
S
S
R1
R2
Fig.B
Fig.C
Fig.D
I/II
P
Fig.E 1
2
3
4
4.1
5
6
7
8
9
10
11
11.1
11.2
11.3
11.4
11.5
11-11.2
12
13
14
14.1
14.2
14.3
14.4
14.5
15
16
17
18
19
30
31
32
33
34
35

Fig.8
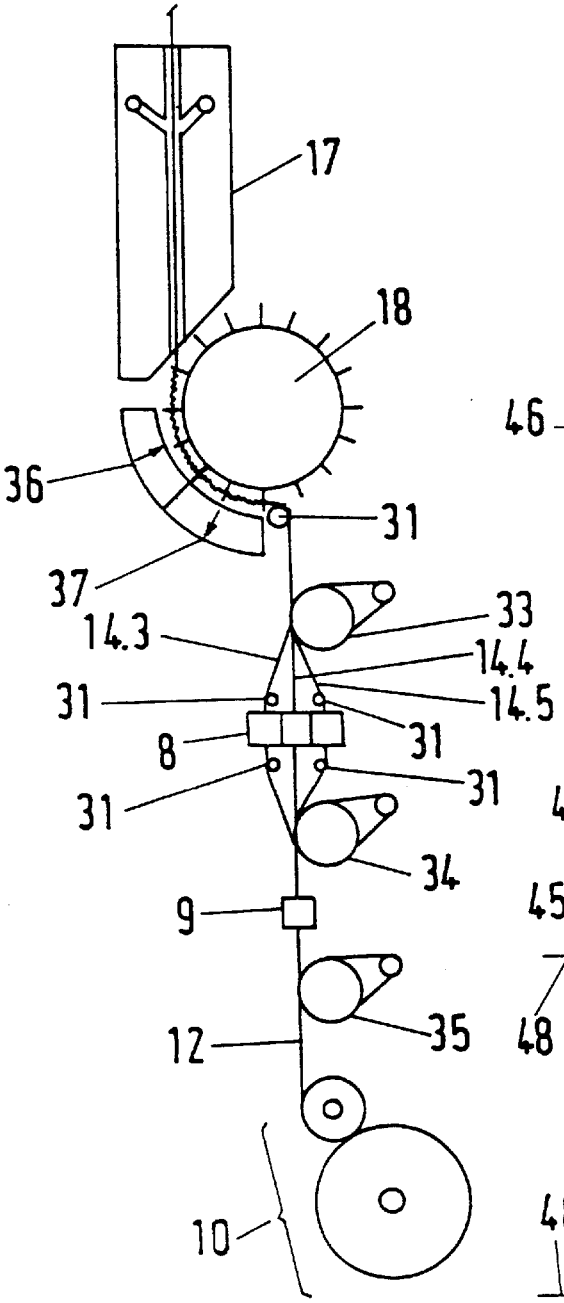
Fig.9
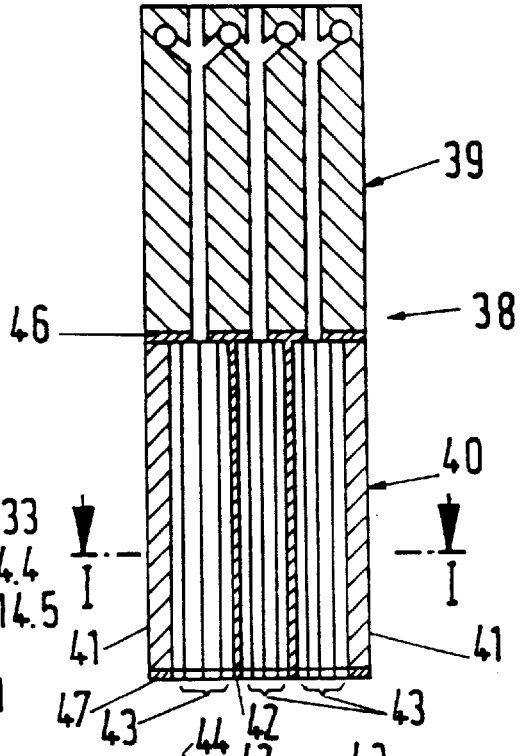
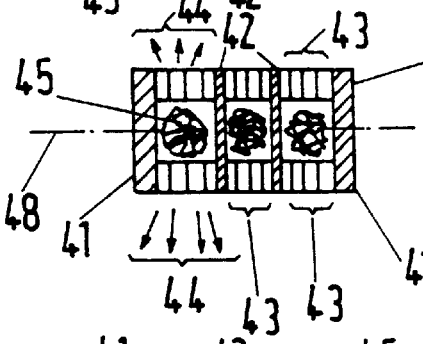
Fig.10
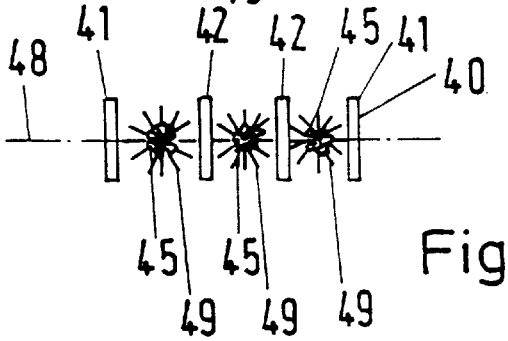
Fig.11

METHOD AND APPARATUS FOR PRODUCING A MULTICOLORED YARN FROM DIFFERENTLY COLORED PART-THREADS OF ENDLESS FILAMENT

FIELD OF THE INVENTION

The present invention concerns a method and an apparatus for producing yarns from multiple filament bundles or thread-parts which are different from one another as, for example, by being of different colors.

The present invention is concerned with improvements in processes for producing yarns of the kind disclosed in U.S. Pat. No. 4,025,595. Such yarns comprise at least two different bundles of continuous filaments, each bundle being separately entangled and the bundles being intermingled to form the yarn. The most obvious "difference" between two "bundles" of filaments is their color where a multi-color yarn is being manufactured, and it is convenient to explain these kinds of processes by referring to differently colored filament bundles. A color difference, however, is not an essential feature of the invention. Desirable "effects" in terms of yarn structure and appearance can be obtained by combining bundles of filaments exhibiting other "differences", some of which are referred to in U.S. Pat. No. 4,025,595.

BACKGROUND OF THE INVENTION

From a European Patent Publication under the Number 0485871 B1 (Barmag) a method is known in which differently colored part-threads, each supplied from a respective cooling shaft, are each guided via a finish application device through a pre-compacting device and subsequently are drawn using a pair of draw rolls, textured in a texturizing nozzle, cooled on a cooling drum, are jointly compacted in an entangling nozzle and subsequently are wound up.

In this arrangement the compacting device between the finish applicator device and the drawing rolls comprises entangling nozzles for each part-thread. These generate the tight entanglement spots known as such. Such tight spots, which prove disadvantageous in the texturizing process are according to this method dissolved again by means of the drawing rolls before the part-threads reach the texturizing nozzle.

The process explained in U.S. Pat. No. 4,025,595 was designed for relatively low spinning speeds in comparison with modern spinning processes. Furthermore, texturized products could be obtained only by subsequent processing of intermediate products obtained in the so-called "spin-draw-winding" process described in the U.S. patent specification.

The production of similar yarns by modern on-line processing has proved difficult so far, particularly where the continuous processing line includes a texturizing stage. The entangling step disclosed in U.S. Pat. No. 4,025,595 tends to interfere with the performance of the texturizing step.

One approach to this problem can be found in EP-B-485871 and EP-A-434601. In these cases the filament bundles are treated upstream from the texturizing stage to ensure that they remain separate from each other, with the aim of maintaining the "individuality" of each bundle in the final yarn product. These processes have achieved a degree of success, but they do not provide the yarn producers with the required reliability and flexibility bearing in mind the fact that "yarn producers" constitute a diverse group of organizations with differing marketing and product strategies.

SUMMARY OF THE INVENTION

The present invention provides a method of producing a yarn comprising a plurality of different filament bundles, the method including the step of joining the bundles together to form the yarn e.g. by intermingling. The method is characterized by the step of treating at least one filament bundle individually upstream of the joining stage and downstream of all preceding drawing, texturizing and combining stages. The individual treatment can be designed to increase the degree of individuality of the treated bundle in the yarn product obtained after joining the bundles. The individual treatment can (for example) comprise a treatment designed to increase the compactness of the bundle (e.g. entangling) as it enters the joining stage. In the preferred embodiments each of the bundles is treated individually immediately before it enters the joining stage.

Insofar as preceding treatment stages may have involved bringing the bundles of filaments together (for example, for texturizing in a common texturizing chamber), it will be necessary to separate them again as far as required to enable the individual treatment according to this invention. In the preferred embodiments, the bundles are kept separate as far as the joining stage. However, it is not always economically possible to satisfy the goal of "separate treatment until joining" and various measures can be adopted to improve the separability of the bundles even where they are brought together prior to joining. Such measures include entangling of the individual bundles and twisting of the individual bundles.

The "difference" between two filament bundles processed,according to this invention may include differences of color, titre, numbers of filaments in the bundles, polymer type, dyeability, cross-section, or additive content.

The invention provides a highly controllable process for influencing the structure and/or the appearance of the yarn product, that is a highly efficient method for creating "effects". This is due to the fact that the individual treatment step is immediately followed by the joining step—there are no intervening process stages, which tend to dilute the effect or which have to be taken into account in determining the degree of individual treatment. For example, one kind of individual treatment involves the step of binding the filaments of a bundle together "locally" (formation of 'tight spots")—the bound "localities" being spaced along the length of the bundle. In a method according to this invention, the number of bound localities per unit length of filament, the tightness of the binding at each locality and the regularity of the binding operations along the length of the bundle can be controlled by reference to the desired effect, without limitations imposed by other processing stages except joining. As already suggested in U.S. Pat. No. 4,025,595 (the disclosure of which is incorporated by reference in its entirety) it is then possible to generate desirable "effects" by "balancing" the individual treatment(s) with the collective treatment in the joining stage.

BRIEF DESCRIPTION OF THE DRAWINGS

The present invention is further described in more detail with reference to the drawings, in which FIG. A diagrammatically depicts a simplified yarn production system according to the invention;

FIG. B shows diagrammatically an untreated bundle of filaments or "part-threads";

Figures 1, 2, 3, 4:
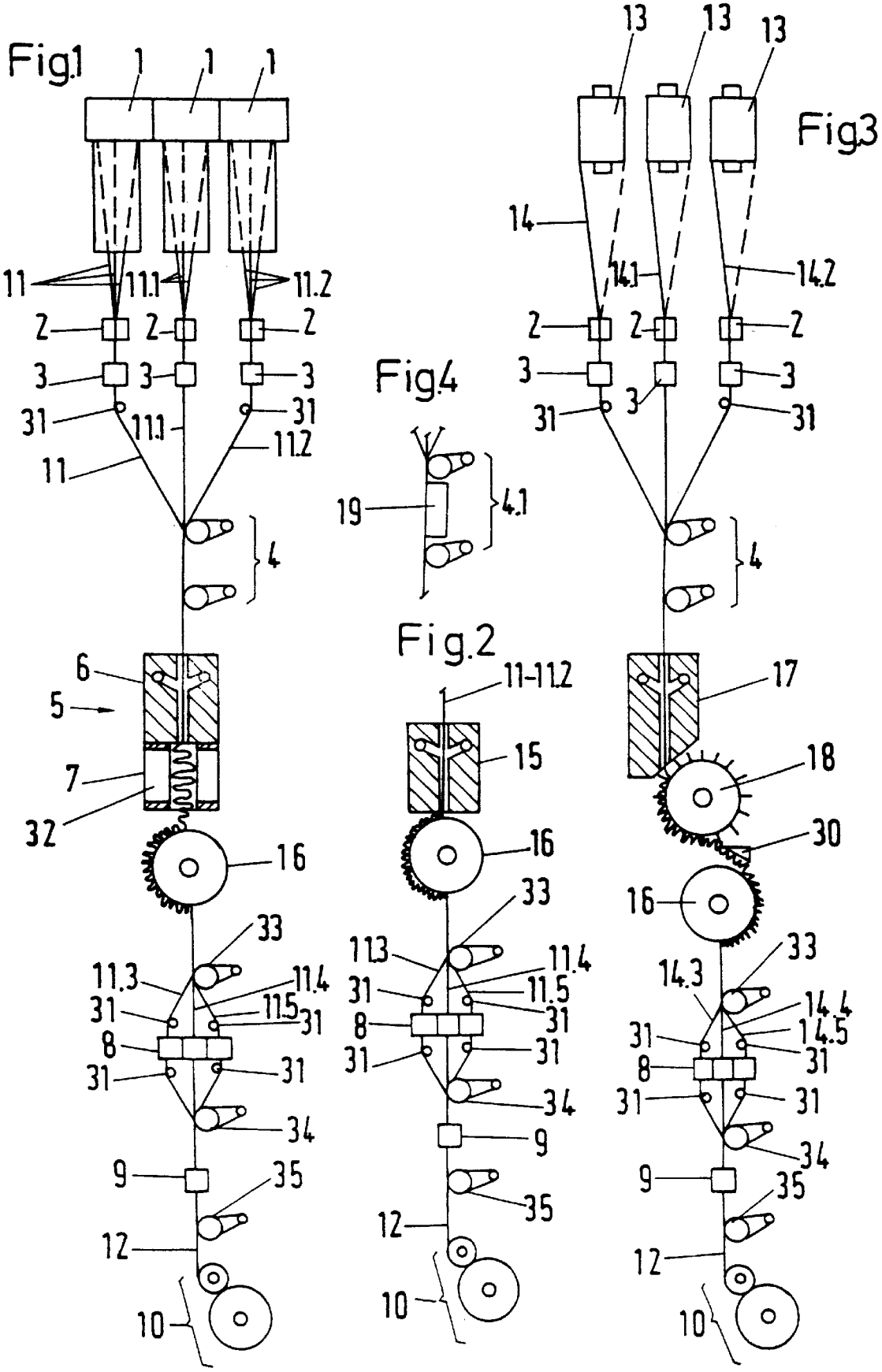

FIG. C is a view similar to FIG. B but showing the filaments of a compacted bundle;

FIG. D is a view showing the filaments of a bundle that has been compacted in a different way;

FIG. E shows schematically a device for inserting "tight spots" into a bundle of filaments;

FIG. 1 is a schematic view showing more completely an apparatus according to the invention for producing an inventive multicolored yarn from part-threads of different colors, or of different staining characteristics;

FIG. 2 shows an alternative embodiment of a part of the apparatus shown in FIG. 1;

FIG. 3 shows an alternative embodiment of the apparatus according to the FIG. 1;

FIG. 4 shows an alternative embodiment of a detail of the inventive apparatus, FIGS. 5 through 9 each show an alternative embodiment of a part of the apparatus according to the FIG. 1;

FIG. 10 is a cross-sectional view according to FIG. 9 along the section lines I—I shown in FIG. 9; and FIG. 11 shows an alternative for the cross-section shown in the FIG. 10.

DETAILED DESCRIPTION OF PREFERRED EMBODIMENTS

By way of example, an embodiment of the invention will be described with reference to the process disclosed in WO 96/09425 (U.S. Pat. No. 5,794,868), the disclosure of which is incorporated by reference herein in its entirety. The major elements of the process are shown in FIG. A. For simplicity of illustration, only two filament bundles I and II are shown. After the bundles have been separately spun (spinning beam and nozzle packs not shown), they are drawn by passing them around first godet G1 and a second godet G2 before winding in a winder W. In accordance with the invention, the bundles of filaments are treated individually at T1 and T2, and the treated bundles are joined to form a yarn at J.

FIG. B shows schematically a bundle of untreated filaments—filaments of an untreated bundle are free to "merge" with those of another untreated bundle if the two bundles are brought together. One method of limiting the freedom of the filaments to "merge" in this way is to form "tight spots" S in each bundle, as shown in FIG. C. Such tight spots can be formed, for example, by intermingling. Such tight spots are generated in intermingling if a jet of air traverses the running bundle of filaments transversely, separating the bundle into two portions to each of which an opposite twist is imparted, which twist is off-set as soon as the bundle of filaments leaves the zone of the air jet, in which arrangement the filaments are intermingled, and thus tight spots are formed, as the two portions are untwisted. As seen in the direction of filament transport, the back tight spot has passed through the same process.

Another method of limiting the freedom to merge is to twist the filaments together, for example as illustrated schematically in FIG. D. As is well-known, it is not possible to insert "true twist" in a running yarn (bundle of filaments) by means of a twister disposed between the ends of the yarn. It is, however, possible to insert a form of "reversing twist' as indicated in FIG. D, where the filament bundle exhibits a first twist direction in region R1 and a second twist direction in region R2, and it is possible to "fix" this twist pattern by inserting twist stops in the yarn structure. The insertion of "twist stops" can be achieved by joining the treated bundle with another bundle in unit J.

In FIG. E a device is shown schematically that can be used to insert "tight spots" S into a bundle of filaments. The device comprises a common inlet (indicated by the arrow P) and three outlets (indicated by smaller arrows). The bundle of filaments is passed in sequence past the three outlets and is thereby entangled. Similar air jet processing can be used in the joining stage, but the pressures applied in intermingling (joining) are preferably much higher than those applied in individual intermingling, e.g. 0.1 to 3 bar in intermingling (individual treatment e.g. T1 and T2) and approximately 6 bar in joining (J). The spacing of the units T1, T2 from the unit J should be adequate to prevent mutual interference, unless such interference is acceptable in view of the effect to be achieved (random influences).

The arrangement shown in FIG. A is "simple" insofar as the filament bundles can be kept clearly separate (spaced from each other) up to the joining stage J. This is not always possible, as shown for example by the configurations illustrated in EP-A-434601. In such cases, it is desirable to provide additional means to prevent "merging" of the filament bundles prior to the (controlled) intermingling at the stage J. "Merging" here refers to the tendency of filaments from two originally separate bundles to intermix in an uncontrollable manner when the bundles are brought into contact with each other if no measures are taken to prevent this intermixing. Appropriate measures are known from the prior art previously mentioned.

The invention is not limited to treatment of the filament bundles by air jets. Treatment of the individual bundles and joining of the bundles can be carried out for example by applying adhesive materials or by forming "welded spots". Depending upon the effect to be achieved, it may be desirable to leave one of the bundles untreated prior to joining—the untreated bundle will then give a "fluffy" effect in the yarn.

The advantage of the present invention is seen in that by compacting the individual part-threads (T1 and T2 in the FIG. A) upon texturizing (FIGS. 1 through 8) and prior to the compacting stage which later on is called collective compacting of the joined part-threads (J in FIG. A), the quality, i.e. the reliability of the color separation and thus of the color distinction of the individual part-threads in the yam product is improved over the state of the art and is rendered repeatable.

Before the Figures are described, various further detailed solutions for effecting the compacting process, or the texturizing process respectively, are to be mentioned, to which the description based on the further Figures refers.

The term "compacting" herein is understood to signify the compacting of the filament bundles, namely either over the full length of the filament bundle using a false twisting action or at isolated spots only using an entangling nozzle. Thus, e.g. entangling nozzles used as a compacting means are known from the U.S. Pat. No. 4,025,595, and from U.S. Pat. No. 3,364,537 or U.S. Pat. No. 3,426,406 respectively, and false twist nozzles are known from the EP-0434601 A1 which in the form described therein also can be used as compacting means.

Also each of EP-009763, EP-01 10359 A1, EP-0123072 A1, EP-0123829 discloses a texturizing nozzle which advantageously can be opened in such a manner that one or a plurality of part-threads can be inserted, in which arrangement texturizing is effected upon closure of the texturizing nozzle. As texturizing nozzles of this type function according to the injector principle, they not only are able to transport the part-threads upon closure of the nozzles but also to suck them in, if required. Also, texturizing nozzles which cannot be opened for transferring the threads through the texturizing nozzle can be used. A further possibility of transferring the threads through the texturizing nozzles is seen in the use of suction pistols.

Also a texturizing nozzle is known from CH-680140 A5 which at its entrance is provided with blowing nozzles which merge tangentially into the yarn conveying duct for generating a protective twist in the filament bundles.

In the texturizing nozzles known from the EP-0039763 A1, EP-0123072 A1, EP-0123829 A1, heating and transport of the part-threads is effected in a heating and conveying element each which is designed as a duct or as a chamber, and the formation of a plug, or the texturizing or crimping respectively, is effected in a second chamber from which the heated gas blown in escapes again in such a manner that a plug can be taken from the chamber. The plug is placed for cooling into a transporting cooling element, e.g. onto a rotating cooling drum.

A further texturizing device is known from the EP-310890 A1 (Rolltex) which comprises a heating and conveying duct for heating and transporting the part thread, or of the yarn respectively, in which arrangement the plug is transferred from a needle studded roll onto a cooling drum for cooling the plug.

Texturizing means are known also from the U.S. Pat. No. 3,255,508 (Mitsubishi) which comprise a heating and conveying nozzle and an adjoining cooling drum, the plug being formed as the heated and transported thread impacts the cooling drum.

In FIG. 1 an apparatus is shown for producing a multicolored yarn using e.g. three cooling shafts. As shown in this example, a differently colored part thread or filament bundle 11, 11.1, 11.2 is generated in each of the cooling shafts. Each of the part-threads 11, 11.1, 11.2 is guided through a finish applicator means 2, which as a rule is an oil applicator means. Yarns of this type can be composed of two or more part-threads.

After leaving the finish applicator means 2, the part-threads 11 through 11.2 each are brought separately into a corresponding compacting means called pre-compacting means 3 which either is an entangling means known as such or preferentially is a false twist means known as such. Both such means have been mentioned above as representative of the state of the art.

After leaving the pre-compacting means, the part-threads 11 through 11.2 are drawn to be a predetermined degree using the drawing rolls 4 and in the process are warmed up, or heated respectively. That is, they are brought into the temperature zone of the glass transition point (second order transition temperature), or to the thermoplastic state respectively. If entangling means are applied as pre-compacting means, the entanglement is chosen such that, during the drawing of the entangled part-threads 11 through 11.2, the entanglement tight spots are removed at least partially in such a manner that no impairment of the texturizing quality in the yarn results.

Upon leaving the draw rolls 4 the part-threads 11 through 11.2 are texturized jointly in a texturizing nozzle 5. The part-threads are sucked into the nozzle 5 according to the injector principle. They are heated and transferred into a texturizing element 7 where they are compressed into a plug. The heating and transporting gas escapes between slats 32 or other air permeable elements. There is a reduction in transporting speed and friction of the individual fibers of the threads on the wall of the cooling and texturizing elements 7. The plug subsequently is transferred to a cooling drum 16. The operator separates the plug before or after it reaches the cooling drum 16 into textured part-threads 11.3 through 11.5 (which also applies for the FIGS. 2 through 6 and 8 to be described later on) and they are guided via a take-off roll 33, and if required via a deflecting thread guide 31, into a corresponding compacting means 8, (called herein after-compacting means). The after-compacting means 8 here can be a false twist means known as such or mentioned with reference to the FIG. D, or preferentially an entangling means known as such. The handling of the plug by the operator is effected by means of a suction pistol known as such, the separation into the part-threads being effected manually and by means of thread guides, not shown here, each coordinated to a part-thread.

Upon leaving the after-compacting means 8 the part-threads 11.3 through 11.5 are united, via deflecting thread guides if required, on a roll 34 and subsequently are jointly compacted in a compacting means 9 called herein collective compacting means. Such collective compacting means are designated J in FIG. A. The part-threads or bundles are preferentially entangled jointly or are jointly false twisted. Then the resulting yarn 12 is guided via a roll 35 and wound up in a winding device 10. Since the rolls 33, 34 and 35 are transporting rolls, one or more of them can be dispensed with, depending on the materials processed, in instances where experiments show such to be feasible. In the latter case the threads are taken off the cooling drum and pulled via the after-compacting means 8 and through the collective compacting means 9 directly.

In the FIG. 2 an alternative embodiment is shown differing from the one shown in FIG. 1. In the FIG. 2 arrangement a heating and conveying element 15 is provided for texturizing the part-threads 11 through 11.2 downstream from the draw rolls 4. The element 15 provides the same functions as the element 6 and adjacent to it a cooling drum 16 known as such from the U.S. Pat. No. 3,255,508 provides the additional function of the element 7. That is, the plug is formed on the cooling drum and is cooled there. The further elements correspond to the ones described with reference to the FIG. 1 and thus are not described further here.

In FIG. 3 an alternative design example is shown. This differs from the one shown in the FIG. 1. Instead of including the cooling shafts 1, individual packages 13 of colored part-threads are provided. In order to texturize the part-threads designated 14 through 14.2 downstream from the draw rolls 4, a heating and conveying element 17 is provided. Its function corresponds to the above mentioned elements 6 and 15. A subsequent needle studded roll 18 receives the bundles which then pass over a plug deviating element 30 to a subsequent cooling drum 16. The combination of the elements 17, 18, 16 and 30 is described in EP-03 10890 A1, and this EP document may be referred to for further details. Other elements in FIG. 3 correspond to elements shown in other Figures mentioned above and thus are not described further here.

It is to be noticed, however, that the use of supply packages 13 (e.g. colored packages) instead of cooling shafts 1 can be applied also in all alternative embodiments shown in the further Figures.

In the FIG. 4 a combination is shown of draw rolls 4.1 with a surface heating element 19 known as such which is provided between the two draw rolls and which serves for heating, in addition to the heating using the draw rolls 4, or alone, the part-threads gliding thereon.

Figure 5:
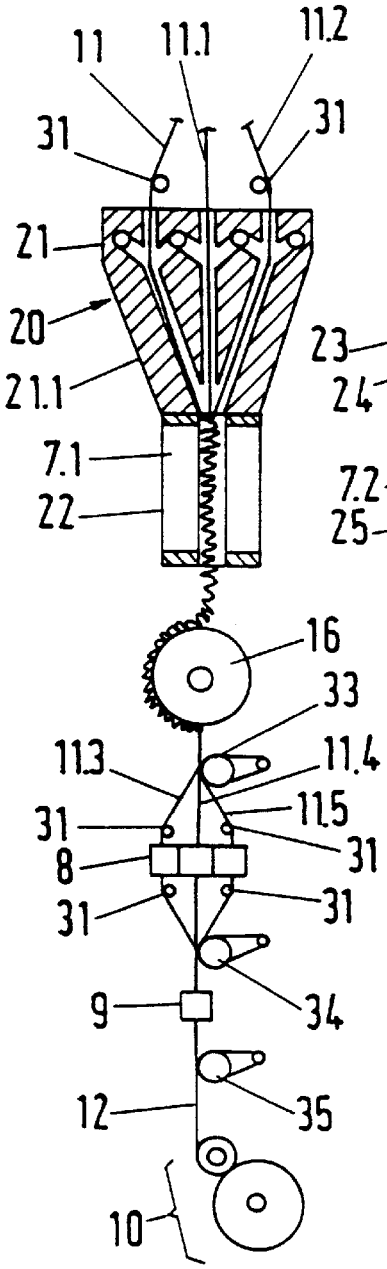

In FIG. 5 an alternative embodiment of a portion of FIG. 1 is shown. Here the texturizing nozzle 20 provides a sucking-in part 21 for each of the part-threads 11 through 11.2, or 14 through 14.2 respectively. This texturizing nozzle imparts a so-called protective twist to the corresponding part-threads. The part-threads subsequently pass into the heating and conveying element 21.1 where they are heated and transported by the transporting medium and crimped into a plug in the subsequent crimping element 22. In this arrangement the individual heating and conveying ducts for the part-threads merge into the texturizing element. That is, imagined symmetry planes of the individual heating and conveying ducts intersect upstream from the texturizing element. The further elements shown correspond to the elements described already and thus are not mentioned again here.

Figure 6:
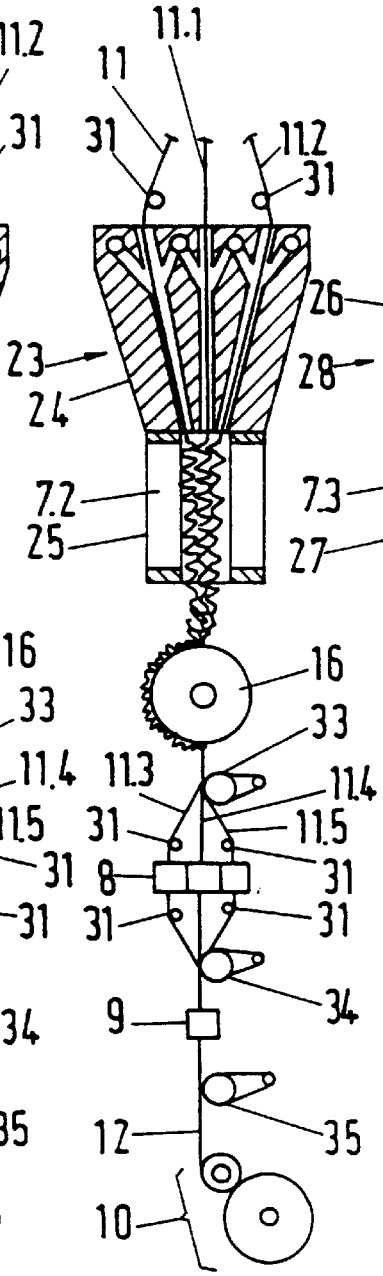

In FIG. 6 an alternative embodiment is shown. Here a texturizing nozzle 23 comprises a heating and conveying element 24 for the part-threads and also a common texturizing element 25. The part-threads are heated and transported individually and are texturized jointly. In the arrangement shown, the individual heating and conveying ducts merge into the crimping element side by side. That is, imagined symmetry planes of the individual heating and conveying ducts intersect outside the heating and conveying element 24, the intersecting point not being shown. The other elements in FIG. 6 correspond to ones described earlier and thus are not mentioned here again.

Figure 7:
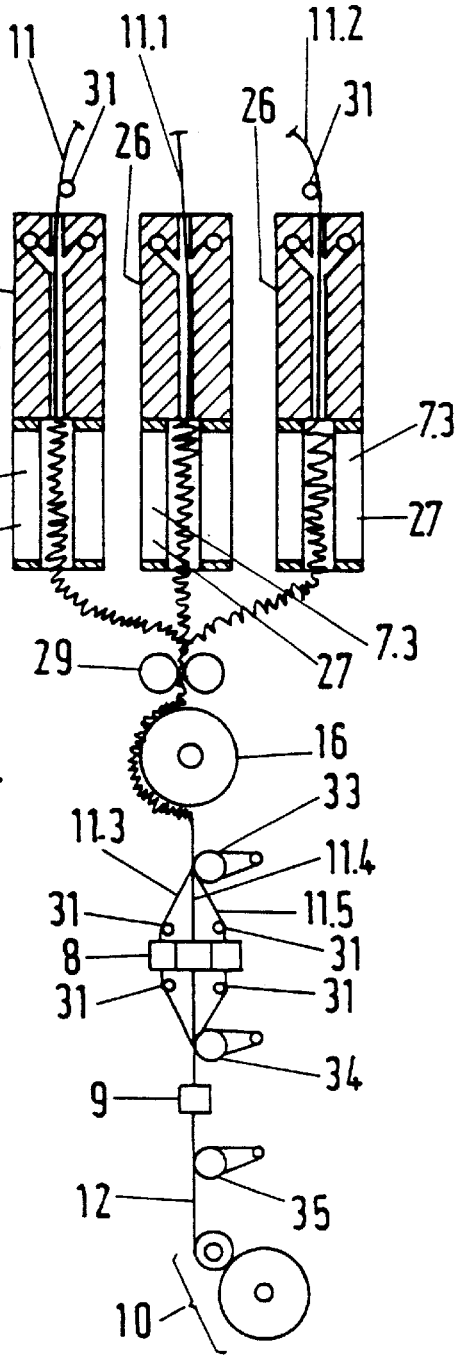

In FIG. 7 an other alternative embodiment is shown. Here, three individual texturizing nozzles 28 are provided each with a heating and conveying element 26 and a crimping element 27 connected thereto for each part-thread. The three plugs from the corresponding crimping element are transferred side by side, depending on the lay-out, either via transporting rolls 29 or directly side by side onto a common cooling drum 16 in such a manner that the separation into part-threads mentioned with reference to the FIGS. 1 through 6 and 8 can be dispensed with here. The further elements shown correspond to the ones described earlier and thus are not mentioned here.

FIG. 8 shows an alternative to the embodiment of FIG. 3. The cooling drum 16 is dispensed with, and a cooling air dispenser 36 and a cooling air suction element 37 are provided in its place around a predetermined section of the needle studded roll 18. Using this arrangement, the plug placed on the needle studded roll is cooled and is guided via a deflecting thread guide 31 to the roll 33 and is transported on as described earlier. Other features shown in FIG. 8 are described with reference to all the other Figures.

FIG. 9 shows a texturizing nozzle 38 which is applicable in the apparatuses shown in the FIGS. 1 through 8. This nozzle is provided with a heating and conveying element 39 which, for each part-thread, contains an individual heating and conveying duct as well as an individual crimping duct in the crimping element 40. The advantage of this embodiment is comparison to the three individual texturizing nozzles according to the FIG. 7 is seen in the thermal and manufacturing economy of the compact design. This can result in lower manufacturing and operating costs.

In FIG. 10 a crimping element 40 is shown in cross-section. This crimping element is composed of two outer walls 41 and intermediate walls 42, as well as of the slats 43 located between them. A free space or room (indicated by the random thread array 45) is provided in the arrangement for formation of the plug. Furthermore, the outer walls 41, the intermediate walls 42, and the slats 43 are mounted by means of an upper ring flange 46 to the heating and conveying element 39. The mutual connection of the outer walls 41, of the intermediate walls 42, and of the slats 43 at the exit of the crimping element 40, is effected using a lower ring flange 47. The reference number 44 designates arrows indicating the manner in which air from the individual ducts (shown only on one of the ducts) can escape from the crimping element. Advantageously, for facilitating insertion of the part-threads, the texturizing nozzle surrounding the threads is designed as two separable halves, as indicated in the FIG. 10 with the imagined symmetry plane 48.

FIG. 11 shows an alternative cross-section of an arrangement similar to FIG. 10. Here the slats are arranged in a ray-like array, as compared to the parallel arrangement shown in the FIG. 10. The further elements correspond to the elements shown in the FIG. 10 and thus their further description is dispensed with.

Furthermore, it is to be noticed with reference to the Figures that the yet to be texturized part-threads, located up to the texturizing means, are designated 11 through 11.2, or 14 through 14.2 respectively, and that downstream from the texturizing means up to the collective compacting means 9, the texturized part-threads are designated 11.3 through 11.5, or 14.3 through 14.5 respectively. Downstream from the collective compacting means 9, the filamentary body is designated as yarn 12.

Also, in all alternative design examples shown in the FIGS. 1 through 11 part-threads can be processed which are supplied from the cooling shafts 1 or from thread packages 13.

In the arrangements shown in the Figures, deflecting thread guides 31 are provided where required, which is indicated schematically.

It is understood that, in all elements functioning according to an injector principle, advantageously a twist imparting principle described in the CH-680140 A5 can be applied in order to impart a protective twist to threads conveyed through the texturizing nozzle. This, in addition to the also mentioned compacting action applied to the part-threads, ensures that if a plurality of part-threads is conveyed through a texturizing nozzle, the individual part-threads will be less entangled mutually but are maintained substantially separate side by side, the upper twist stop for the corresponding part-thread being the nearest roll of the pair of rolls arranged upstream.

A protective twist is useful particularly if the threads as shown in the FIGS. 1 through 5 are to be texturized jointly in a common texturizing nozzle.

Furthermore it is to be mentioned that, if the false twist principle is applied in compacting the part-threads downstream from the finish applicator means 2, said finish applicator means 2 can be used as a twist stop if for any reason no deflecting thread guides are provided, and that the term "differently stainable part-thread is understood to designate threads which in the dyeing process, if e.g. the same colorant is applied, develop different shades or nuances, but desired coloring effects.

Also it is to be mentioned that, in the said after-compacting process using entangling nozzles, the compacting effect may be varied by adapting the pressure (bar) and/or the quantity (kg/h) and/or the temperature of the gas, e.g. air or steam, in such a manner that the number of entanglements per unit length of the thread can be varied more or less as desired. This is applied according to the present invention for varying the color effect in the finished yarn in addition to the variation of the coloring effect by choosing the colors applied.

These parameters (pressure, quantity, temperature of the gas) additionally can be chosen differently for each part-thread in such a manner that in each part-thread a difference in the entanglement, and thus in the intensity of color distinction, is obtained.

What is claimed is:

1. A process for forming a continuous filament yarn from at least two individual filament bundles wherein at least one physical characteristic of the filament bundles is different so as to produce a desired visual effect in the continuous filament yarn, said process comprising the steps of:

supplying at least two separate filament bundles wherein at least one physical characteristic of the filament bundles is different and selected to produce a desired visual effect in the continuous filament yarn formed from the filament bundles;

separately texturizing each of the filament bundles so as to prevent mixing of the filaments between filament bundles during said separate texturizing;

jointly compacting the separately texturized filament bundles after said separate texturizing so as to merge the bundles into the continuous filament yarn with the desired visual effect; and further comprising individually compacting the filament bundles in a pre-compacting step prior to said separately texturizing step.

2. The process as in claim 1, further comprising drawing the filament bundles prior to said separately texturizing step.

3. The process as in claim 1, further comprising individually compacting the filament bundles in a post-compacting step after said separately texturizing step and prior to said joint compacting step.

4. The process as in claim 1, wherein the filament bundles have different color characteristics, said process for forming a multi-colored continuous filament yarn.

5. The process as in claim 1, where in the at least one different physical characteristic of the bundles is one of color, cross section, dyeability, or shade.

6. The process as in claim 1, wherein said supplying step comprises continuously co-spinning and cooling each of the filament bundles.

7. The process as in claim 1, wherein said supplying step comprises supplying the filament bundles from pre-formed individual packages.

8. The process as in claim 1, further comprising false twisting the individual filament bundles in a post-compacting step after said separately texturizing step and immediately subjecting the false twisted filament bundles to said joint compacting step.

9. A process for forming a continuous filament yarn from at least two individual filament bundles wherein at least one physical characteristic of the bundles is different so as to produce a desired visual effect in the continuous filament yarn, said process comprising the steps of:

supplying at least two separate filament bundles wherein at least one physical characteristic of the filament bundles is different and chosen to produce a desired visual effect in the continuous filament yarn;

texturizing the filament bundles;

producing a false twist in at least one of the filament bundles in a post-compacting process subsequent to said texturizing; and immediately subsequent to said false twisting step jointly compacting the filament bundles so as to merge the bundles into the continuous filament yarn having the desired visual effect.

10. The process as in claim 9, comprising false twisting all of the filament bundles in said false twisting step.

11. The process as in claim 9, further comprising pre-compacting the filament bundles prior to said texturizing step.

12. The process as in claim 9, wherein said supplying step comprises continuously co-spinning and cooling each of the filament bundles.

13. The process as in claim 9, wherein said supplying step comprises supplying the filament bundles from pre-formed individual packages.

14. The process as in claim 9, wherein said texturizing step comprises separately texturizing each of the filament bundles and preventing mixing of the filaments between bundles during said separate texturizing.

15. The process as in claim 9, wherein the filament bundles have different color characteristics, said process for forming a multi-colored continuous filament yarn.

16. A process for forming a continuous filament yarn from at least two individual filament bundles wherein at least one physical characteristic of the filament bundles is different so as to produce a desired visual effect in a combination of the bundles in the continuous filament yarn, said process comprising the steps of:

supplying at least two separate filament bundles wherein at least one physical characteristic of the filament bundles is different and selected to produce a desired visual effect in the continuous filament yarn;

drawing the separate filament bundles;

texturizing the filament bundles immediately subsequent to said drawing step in a texturizing process which includes imparting a false twist to the individual filament bundles that extends back from a texturizing device used in said texturizing step to a drawing device used for said drawing step; and jointly compacting the filament bundles so as to merge the bundles into the continuous filament yarn with the desired visual effect.

17. The process as in claim 16, wherein said texturizing step comprises conveying the separate filament bundles through a texturizing chamber of the texturizing device with air jets upstream of the texturizing chamber, and using the air jets to impart the false twist to the filament bundles.

18. The process as in claim 17, wherein said texturizing step further comprises separately texturizing each of the filament bundles and preventing mixing of the filaments between bundles during said separate texturizing.

19. The process as in claim 16, further comprising compacting the filament bundles in a pre-compacting step prior to said drawing step.

20. The process as in claim 16, further comprising compacting the filament bundles in a post-compacting step subsequent to said texturizing step and prior to said joint compacting step.

21. A method for producing a multi-colored yarn from differently colored part-threads, comprising:

pre-compacting each of the part-threads;

drawing and texturizing the part threads subsequent to said pre-compacting step;

post-compacting each of the part-threads separately subsequent to said drawing and texturizing; and jointly compacting the part-threads subsequent to said post-compacting and winding the jointly compacted part-threads as a yarn.

22. A method for producing a multi-colored yarn from differently colored part-threads, comprising:

pre-compacting each of the part-threads in a false twist compacting process;

drawing and texturizing the part threads subsequent to said pre-compacting step;

post-compacting each of the part-threads separately subsequent to said drawing and texturizing in an entangling compacting process; and jointly compacting the part-threads subsequent to said post-compacting and winding the jointly compacted part-threads as a yarn.

23. An apparatus for producing multi-colored yarns from differently colored part-threads of endless filament, said apparatus comprising:

texturizing means for said part-threads;

common compacting means for all said part-threads downstream from said texturizing means;

a winding device configured for winding a yarn composed of said part threads downstream from said common compacting means;

after-compacting means for each said part-thread upstream from said common compacting means; and pre-compacting means for each of said part-threads upstream of said texturizing means.

24. A process for forming a continuous filament yarn from at least two individual filament bundles wherein at least one physical characteristic of the filament bundles is different so as to produce a desired visual effect in the continuous filament yarn, said process comprising the steps of:

supplying at least two separate filament bundles wherein at least one physical characteristic of the filament bundles is different and selected to produce a desired visual effect in the continuous filament yarn formed from the filament bundles;

separately texturizing each of the filament bundles so as to prevent mixing of the filaments between filament bundles during said separate texturizing;

jointly compacting the separately texturized filament bundles after said separate texturizing so as to merge the bundles into the continuous filament yarn with the desired visual effect; and individually compacting the filament bundles in a post-compacting step after said separately texturizing step and prior to said joint compacting step.

25. The process as in claim 24, further comprising drawing the filament bundles prior to said separately texturizing step.

26. The process as in claim 24, wherein the at least one different physical characteristic of the bundles is one of color, cross section, dyeability, or shade.

27. The process as in claim 24, wherein said supplying step comprises continuously co-spinning and cooling each of the filament bundles.

28. The process as in claim 24, wherein said supplying step comprises supplying the filament bundles from pre-formed individual packages.

29. The process as in claim 24, further comprising false twisting the individual filament bundles in said post-compacting step and immediately subjecting the false twisted filament bundles to said joint compacting step.

30. A process for forming a continuous filament yarn from at least two individual filament bundles wherein at least one physical characteristic of the filament bundles is different so as to produce a desired visual effect in the continuous filament yarn, said process comprising the steps of:

supplying at least two separate filament bundles wherein at least one physical characteristic of the filament bundles is different and selected to produce a desired visual effect in the continuous filament yarn formed from the filament bundles;

separately texturizing each of the filament bundles so as to prevent mixing of the filaments between filament bundles during said separate texturizing;

jointly compacting the separately texturized filament bundles after said separate texturizing so as to merge the bundles into the continuous filament yarn with the desired visual effect;

wherein said jointly compacting step comprises compacting the bundles together as they move through a compacting device at the same rate of speed; and further comprising individually compacting the filament bundles in a post-compacting step after said separately texturizing step and prior to said joint compacting step.

31. The process as in claim 30, further comprising individually compacting the filament bundles in a pre-compacting step prior to said separately texturizing step.

32. The process as in claim 30, further comprising drawing the filament bundles prior to said separately texturizing step.

33. The process as in claim 30, wherein the at least one different physical characteristic of the bundles is one of color, cross section, dyeability, or shade.

34. The process as in claim 30, wherein said supplying step comprises continuously co-spinning and cooling each of the filament bundles.

35. The process as in claim 30, wherein said supplying step comprises supplying the filament bundles from pre-formed individual packages.

* * * * *